US005367744A

United States Patent [19]

Ahlberg et al.

[11] Patent Number: 5,367,744

[45] Date of Patent: Nov. 29, 1994

[54] HINGE CONNECTION

[76] Inventors: Erik Ahlberg, S:t Eriksgatan 109, 113 31 Stockholm; Kurt Ohlson, Harvägen 3B, 178 00 Ekerö, both of Sweden

[21] Appl. No.: 927,521

[22] PCT Filed: Feb. 14, 1990

[86] PCT No.: PCT/SE91/00090

§ 371 Date: Sep. 17, 1992

§ 102(e) Date: Sep. 17, 1992

[87] PCT Pub. No.: WO91/12402

PCT Pub. Date: Aug. 22, 1991

[30] Foreign Application Priority Data

Feb. 14, 1990 [SE] Sweden ..... 90 00536

[51] Int. Cl.[5] ..... E05D 1/00; E05D 3/06

[52] U.S. Cl. ..... 16/227; 16/366

[58] Field of Search ..... 16/227, 366

[56] References Cited

U.S. PATENT DOCUMENTS 3,751,760 8/1973 Wakeman .

FOREIGN PATENT DOCUMENTS 0109466 5/1984 European Pat. Off. .

333523 3/1971 Sweden .

2101202 1/1983 United Kingdom .

2189290 10/1987 United Kingdom .

2203190 10/1988 United Kingdom .

WO88/08186 10/1988 WIPO .

*Primary Examiner*—Lowell A. Larson

*Attorney, Agent, or Firm*—Burns, Doane, Swecker & Mathis

[57] ABSTRACT

The invention relates to a hinge connection which functions to connect a first structural part or panel with a second structural part or panel such that the two structural parts can pivot in relation to one another. The hinge connection includes a first hinge member which is attached to the first structural part and a second hinge member which is attached to the second structural part, and a band which extends between the hinge members, such as to form a hinge element. A first hinge element is intended to coact with one side part of the first structural part and the second side part of the second structural part, whereas a second hinge element is intended to coact with the one side part of the second structural part and the second side part of the first structural part. The band of the hinge element can be stretched to an adapted tension through the intermediary of one of the hinge members.

16 Claims, 2 Drawing Sheets

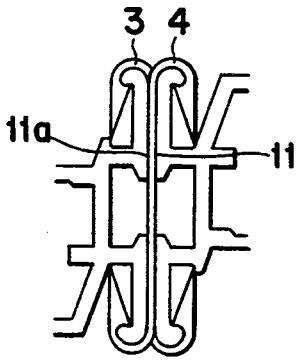
Fig. 4
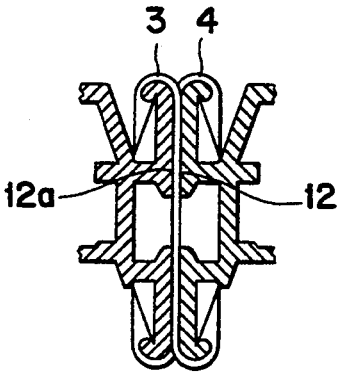
Fig. 5
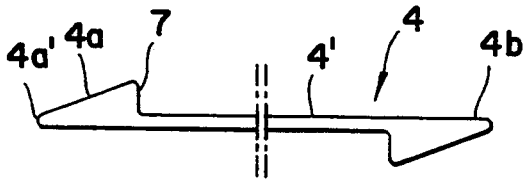
Fig. 6
Fig. 7
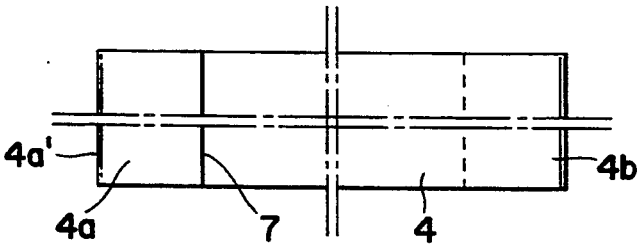
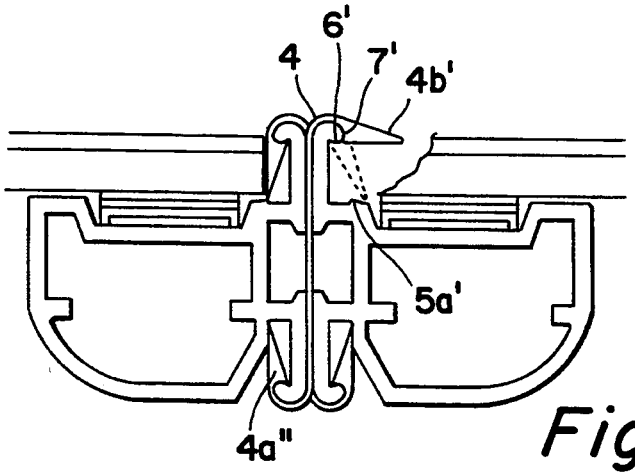
Fig. 8

HINGE CONNECTION

TECHNICAL FIELD

The present invention relates generally to a hinge connection, and more particularly, but not exclusively, to hinged connections of the kind which are intended to pivotally connect a first structural part or panel with a second structural part panel, so as to enable the two structural parts to pivot relative to one another.

Although the inventive hinge connection can be used for general purposes, it has been developed primarily for use in display systems, and then particularly with extendible and collapsible display systems which consist of a plurality of mutually coacting and mutually hinged panels.

Such display systems require the hinge connection to afford mutual rotation of 180° or more between the panels.

In the case of more sophisticated display systems, when the front surface of a first panel or structural part is intended to face towards the front surface of a second panel, it should be possible to rotate the two panels so that the rear surface of the first panel will face towards the rear surface of the second panel.

Thus, it shall be possible for the panels to take any desired position in relation to one another between the aforesaid angular limits.

Of those types of known hinge connections used, among other things, in the type of display system briefly described above, the invention can be considered to relate more specifically to a hinge connection of the kind which will satisfy the abovementioned requirements and which includes a hinge element having a first hinge member which is attached to said first panel or part, and a second hinge member which is attached to said second panel or part, and also at least one band which extends between said panels and said hinge members.

A complete hinge connection of this kind requires at least two such hinge elements positioned adjacent one another, normally three or more hinge elements.

Hinge connections of the aforesaid kind, and thus also hinge connections according to the present invention, obtain particular suitable application in sign systems or display systems, and then particularly in portable sign systems or display systems of the kind which includes a plurality of panels positioned in edge-to-edge relationship, where each panel preferably comprises a frame structure or a covering surface with the frame structure embraced by a plurality of edge strips, wherewith at least two mutually adjacent edge strips or edge-strip parts belonging to respective panels are hinged together by means of one or more such hinge connections comprising a plurality of hinge elements.

In the case of the portable sign systems or display systems of this kind it is usual to use panels that have a right-angled configuration and therewith normally to use four edge-strip parts with each panel.

BACKGROUND PRIOR ART

Hinge connections that can be used in the aforesaid technical fields are known to the art in several different forms, and consequently the following description will deal solely with those constructions which can be used with portable display systems.

Since this field includes a large number of hinge connections, reference is made here to European Patent Publication 0 109 466 as an example of the present state of the art.

European Patent Publication 0 109 466 relates to a hinge connection intended for the aforesaid technical field, in which sprocketwheel-like coaction takes place between mutually adjacent panels.

It is also known to use hinge connections that comprise bands, of which one is attached to one side part of a first edge strip and to a second side part opposite the side part of an adjacent edge strip, whereas an adjacent band is attached to the one side part of the second edge strip and to the second side part of the first edge strip, therewith to define an "S" or a "Z" -shape, according to the principles applicable to the present invention.

As an example of the present state of the art, reference is also made to the illustrated and described subject matter of International Publication WO88/08186 (PCT/SE88/00171).

This publication teaches a hinge connection which comprises a plurality of hinge elements, which comprise a first hinge member, a second hinge member and an intermediate band, where said hinge members are clamped in grooves formed in rails.

In this case, clamping of the members in the grooves is not considered to induce tension in the band, but merely to provide a securing function.

The subject matter described and illustrated in Swedish Published Specification 383 523 also forms part of the present state of the art.

This publication teaches a connection with comprises two hinge components which are mutually connected to at least two connecting means or hinge elements which are made of a bendable material and which intersect one another between said hinge components and which extend along the surface of each said component. Between the attachment points, the connecting means or hinge elements freely abut said hinge components in a slightly extended state in which the hinge components are firmly held together in all pivotal positions thereof, wherein the abutment surface of at least one said hinge component has a convex form relative to the other of said hinge components, to form the pivot area of said element.

DISCLOSURE OF THE INVENTION TECHNICAL PROBLEMS

When considering the present state of the art as described in the aforegoing and when taking into consideration the particular requirements of a hinge connection which, among other things, can be used in a sign and display system of the kind mentioned in the introduction it will be evident that a qualified technical problem is one of being able to construct a hinge connection consisting of two, although preferably three or more hinge elements or hinge arms of simple construction which will afford simple coaction with grooves or the like formed in an adjacent panel, by being able to insert hinge members forming part of said hinge elements readily into said grooves and in doing so ensure that the respective hinge element is well tensioned or stretched by the lever-arm action produced by the one hinge member which during said tensioning process slides along a curved surface or the like, thereby ensuring not only that the structural parts or panels are firmly held together but also that there is obtained a pulling force which exceeds the force required for this purpose.

It will also be seen that a technical problem resides in realizing those advantages which such a hinge element will afford when the first hinge element and also the second hinge element can be mounted in the absence of any great tensioning force, whereas the third hinge element will require a much greater tensioning force, this force being taken over by and distributed on the earlier mounted hinge elements.

It will also be seen that a technical problem resides in the provision of a hinged connection which will afford a rotational angle of up to about 720°, depending on the attachment of the hinge elements.

Another technical problem is one of realizing that a hinge connection which has successfully solved one or more of the aforesaid technical problems is able to provide pivotal coaction of several panels with any desired positioning adjacent one and the same edge surface of another panel.

Another technical problem is one of selecting the most suitable smallest elastic change in length change and/or resiliency of the hinge element and/or its attachment.

When the hinge element is made of plastic material, normally polypropylene, another technical problem is one of realizing the advantage that is afforded when the stretch permitted is so great as to allow the band to have a given permanent length extension.

Another technical problem is one of realizing the technical advantages that are afforded when the hinge element is produced from a suitable plastic material, such that the two hinge members are integral with a band.

It will also be seen that a qualified technical problem is one of providing a hinge connection for the aforesaid technical field which will solve the aforesaid technical problems and which, when mounted on the edge surface between two edge strips or mutually adjacent panels, can utilize a thin hinge band and preferably a groove which completely embraces the band.

It will also be seen that another technical problem is one of providing a hinge connection for use in the aforesaid technical field and which solves the aforementioned technical problems which will afford the advantage that mutually opposite edge parts of mutually adjacent panel edge strips will lie equally as close to one another irrespective of the angles defined between the panels, thereby enabling the troublesome filtration of light through the display, for instance light from lamps located behind the display, to be reduced, even when the panels are subjected to the presence of forces which strive to separate the panels one from the other.

Another technical problem is one of providing a hinge connection for the aforesaid technical field which will solve one of more of the aforesaid technical problems which can be readily fitted to said structural parts with the aid of a number of simple, preferably identical hinge elements.

It will also be seen that a technical problem resides in the provision of a hinge connection of the aforesaid kind and for the aforesaid technical field which will afford the technical advantage of holding a panel or edge strip in position adjacent an adjacent panel or edge strip, even when the panels are subjected to a panel-separating and/or panel-closing force, and particularly when said force is active when the two panels are positioned in one and the same plane.

It will also be seen that a technical problem resides in the provision of a simple hinge connection which can be readily fitted into opposing edge strips for a body framework or panel incorporated in a sign or display system which can be assembled totally with the aid of a plurality of preferably identical hinge elements while parts of the hinge connection coact firmly with the panels without needing to take additional measures for holding the parts together.

In addition to the aforementioned technical problems, a further problem is one of providing a hinge connection for the aforesaid purpose which comprises a plurality of mutually adherent bands and where respective bands have a predetermined tension, determined by the configuration of a lever arm arrangement, adapted for good hinge function through the particular configuration of the members of the hinge element and adaptation of requisite fastener means in the form of grooves.

Another technical problem is one of providing a well adapted band design with hinge members, one hinge member being intended to be fixed in a groove and one hinge member being intended for tensioning coaction with a groove in at least one frame part.

Another technical problem is one of realizing the importance of configuring, in each case, a hinge member with a lever arm whose free end is able to move and bend into firm engagement with an attachment means, preferably in the form of a hooked projection provided in respective edge strips.

Another technical problem is one of realizing the advantages that are afforded when one hinge member having an abutment surface adjacent the lever arm and adjacent the band is permitted to rotate around a curved edge surface formed in the edge strip, so that the band will be stretched to the requisite extent, by means of the lever-arm action, prior to said hinge member being locked to the edge strip with the band in a stretched state.

Another technical problem is one of realizing those advantages that are afforded when sliding is prevented between the edge strips and/or the band attachment as a result of selected tension forces, for instance with the aid of simple means, such as roughening or serrations.

Another technical problem is one of using hinge members and bands which have a well adapted cross-sectional shape, and also of producing said two hinge members and said band from an appropriate material.

Another technical problem is one of realizing those advantages that are afforded when choosing a suitable plastic material whose modulus of elasticity, at least with respect to the band, will provide a force which is commensurate to the desired good function of the hinge connection.

SOLUTION

The present invention provides a solution to one or more of the aforesaid technical problems and is based on a hinge connection which is intended to pivotally connect a first structural part or panel to a second structural part or panel such that both panels are able to rotate relative to one another.

More specifically, the invention relates to a hinge connection comprising at least two, normally three or more, hinge elements where each hinge element has a first hinge member which is attached to a first panel or edge strip, and a second hinge member which is attached to a second panel or edge strip, and a band which extends between said hinge members.

In accordance with the invention, when attaching a hinge element to a structural part or a panel a hinge member of said hinge element will function to exert a tension force on the band, through the intermediary of a special lever-arm arrangement.

As preferred embodiments which lie within the scope of the invention, it is proposed that the hinge member, within an area adjacent the band, is arranged to slide over an edge surface provided in the panel or an edge-strip profiled section for accommodating the panel, through the action of the lever-arm arrangement.

The tension force obtained by the lever-arm arrangement is generated and sustained by an elastic change in length and/or a resiliency which in normal instances is preferably greater than 0.5 mm, particularly when using plastic material.

The tension force obtained by the lever-arm arrangement on the table should also be generated and adapted by permitting permanent length extension in the band, particularly in the case of plastics material.

Each hinge element is assigned at least one lever-arm arrangement and two hinge elements are arranged in close relationship in each case.

Respective hinge elements consist of said first and said second hinge members and said band, and are formed as an integral, slightly elastic unit, and said members are intended to so coact with respective structural parts or edge strips as to stretch the band when said parts or edge strips are rotated.

It is also proposed that the respective hinge members have an extension such that their ends or points are able to coact with an attachment means, preferably in the form of a hooked projection in respective parts or edge strips.

Furthermore, a lever-arm member is preferably arranged for movement around a curved edge surface formed in said structural part, such that pivotal movement will induce the necessary tension in said band, through its stretched extension, normally less than 2 mm.

This lever-arm member is preferably provided with a curved abutment surface which is intended to coact with a similarly curved edge surface. This edge surface and/or said abutment surface may be provided with sliding-preventing means, such as a roughening or serrations.

A surface on the first structural part or edge strip and facing towards the second structural part or edge strip, and a surface on the second part and facing towards the first part at an angle of 180° between said parts or said panels, are preferably mutually parallel so as to form a stable position of adjustment.

The surface can be formed or defined by two parallel edges or may have the form of a flat surface with a width which is negligibly smaller than the length of the band.

of the two surfaces defining said surface one or both are curved, and are preferably of part-circular configuration, so as to facilitate rotation of the plates relative to one another.

Furthermore, a first hinge element comprising two hinge members and an intermediate band is arranged to coact, via said members, with one side part of a first edge strip and a second side part of a second edge strip, and a second hinge element, similar to the first part, is arranged to coact with one side part of the second edge strip and the second side part of the first edge strip.

As suitable embodiments within the basic concept of the invention it is also suggested that the first and the second hinge element, and preferably third and other hinge elements shall be positioned parallel to and adjacent one another with a small space therebetween.

It is also proposed that one hinge member of one hinge element is identical to one hinge member of the second hinge element, and that the first hinge element is identical to the other hinge element, so that solely identical hinge elements are required for a complete hinge connection.

ADVANTAGES

Those advantages primarily afforded by the inventive hinge connection reside in the provision of the possibility of constructing with the aid of a few hinge elements a complete hinge connection which will enable a first structural part to be held hinged to a second structural part without requiring the provision of broad edging strips for this purpose. Due to its elasticity and tension, the hinge element also affords a holding force which is operative in bringing an edge part of the first structural part against an edge part of the second structural part and to counteract any tendency towards slipping when the panels are subjected to a force, e.g. a shear force in a direction away from one another.

The inventive hinge connection is characterized primarily by the features set forth in the characterizing clause of the following claim 1.

BRIEF DESCRIPTION OF THE DRAWINGS

A hinge connection intended for pivotally connecting a first structural part or panel to a second structural part or panel such that said two structural parts can rotate in relation to one another will now be described in more detail with reference to the accompanying drawings, in which

FIG. 4 illustrates a second embodiment of an edge strip adapted for a hinge connection according to the invention;

FIG. 5 illustrates a third embodiment of an edge strip adapted for a hinge connection according to the invention;

FIG. 6 is a side view of a hinge element comprising two hinge element members and an intermediate band of adaptable length;

FIG. 7 is a top view of the part shown in FIG. 6; and

FIG. 8 illustrates an example of how a hinge element is tensioned or stretched in accordance with the invention.

DESCRIPTION OF EMBODIMENTS AT PRESENT PREFERRED

Figure 1:
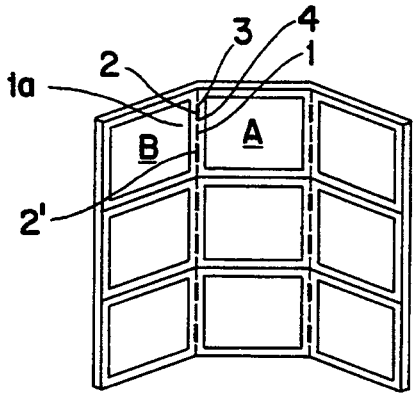
FIG. 1 illustrates a sign or display system comprising a plurality of panels which are each embraced by four edge strips.

FIG. 1 is a perspective view of a portable sign or display system which comprises nine different but identical panels positioned in edge-to-edge relationship.

Just how many panels are included in the display and their positioning in rows and columns is immaterial to present invention, and any desired number of panels can be used.

Each panel may comprise two mutually spaced panel bodies, although normally only one panel body on one side. The panel may present cover surfaces or plates which may be covered in fabric or some other suitable material, and an edge strip which embraces a panel body and which comprises a number of edge-strip parts.

Since all panel bodies or panels are of identical configuration, only the panels "A" and "B" will be referred to in the following, these panels being embraced, in a known manner, by a number of edge-strip parts, of which the edge-strip part 1 chosen for the purpose of this description is positioned vertically.

Located adjacent the edge strip 1 of the panel "A" and opposite said edge strip is an edge strip 1*a* for the panel "B". The configuration of edge strips 1 and 1*a* and their coaction with the panels "A" and "B" will not be described in detail.

When several of the panels of the display system are to show one single picture or image, the exposable parts (1 and 1*a* in FIG. 1) will encroach on the total picture or image surface, and consequently it is desired to expose the smallest possible part of the edge strip 1 and 1*a*.

Thus, each of the panels "A" is embraced by a number of edge strips or edge-strip parts, e.g. three or more normally four edge strip or edge-strip parts, wherein at least two mutually adjacent edge strips 1, 1*a* of respective panels are hinged together by means of one or more hinge connections 2.

The practical condition for obtaining a good hinge connection in accordance with the invention is to use three or more hinge elements 3, 4.

Normally, two hinge element 3, 4 can be placed at the location identified by the reference numeral 2, and two hinge element at the location identified by reference 2', although the hinge element can be positioned in any desired location and in any desired numbers without affecting the hinge function.

With reference to FIG. 1, an edge strip intended for the panel "A" is referenced 1 and an adjacent edge strip intended for the panel "B" is referenced 1*a*, and the panels are joined by two hinge connections 2, 2' each comprising two or three hinge elements.

It also lies within the scope of the invention to position similar hinge connections adjacent one or more other edge strips, the function of these hinge connections being identical to the function of the hinge connection described below.

One embodiment of a suitable inventive hinge connection will now be described in more detail with reference to FIG. 2.

The hinge connection 2 is thus intended to pivotally connect a first constructional part or panel "A" with a second part or panel "B" such that said two parts and their respective edge strips are able to rotate through at least 360° or substantially 360° in relation to one another.

It will be understood, that this angle of rotation may be made greater or smaller, depending on the attachment of the hinge members, the length of the band and the cross-sectional shape of the profiled sections.

The hinge connection 2 comprises a first hinge element 3 having a first hinge member 3*a* which is attached to the edge surface 1' on the first edge strip 1, and a second hinge element 4 having a second hinge member 4*b* which is attached to the edge surface 1'' on the first edge strip 1.

The hinge element 3 passes around the edge strip 1 and extends over a part of the edge strip 1*a* and is fastened to the edge surface 1*a''* of said edge strip 1*a*.

The hinge element 4 extends partially around the edge strip 1*a* and also partially around the edge strip 1 for coaction with the edge surface 1''. The hinge element 3 can be considered to comprise a first hinge member 3*a*, a band 3'and a second hinge member 3*b* which are intergral with one another so as to form a single unit, and the hinge members 3*a*, 3*b* are intended to coact with respective edge strips 1, 1*a* in a manner which causes said strips to stretch the band 3'.

The hinge element 3 and 4 are mutually identical.

Figure 2:
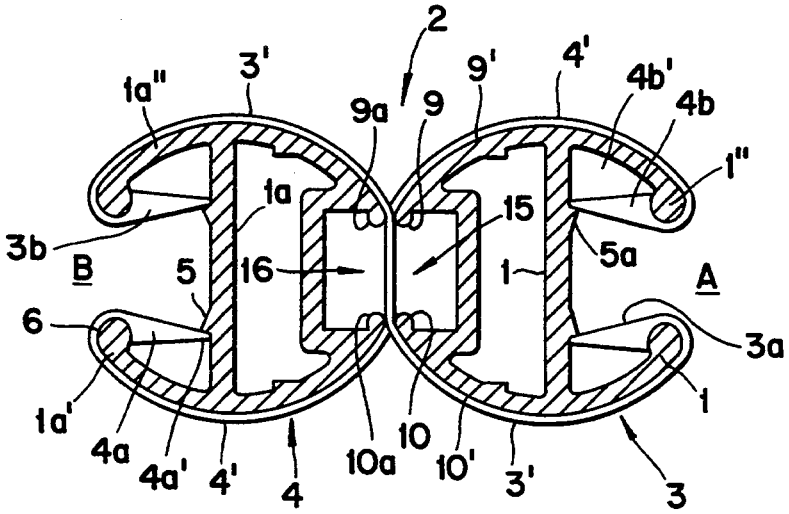
FIG. 2 illustrates a first embodiment of a hinge connection between two edge strips, and also shows two of three identical hinge elements.
Figure 3:
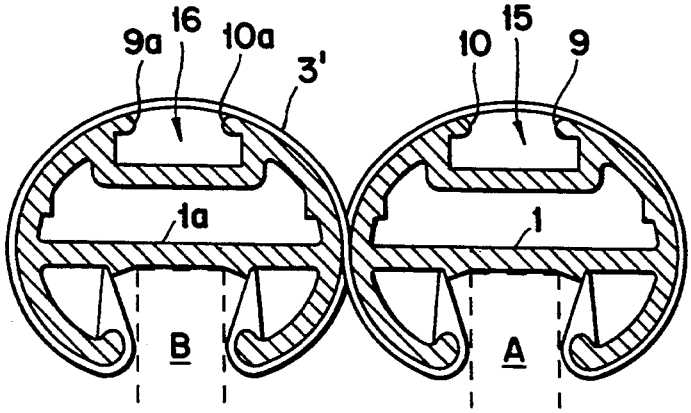
FIG. 3 shows the hinge connection according to FIG. 2 rotated through 180°.

In the FIG. 3 illustration, the panels "A" and "B" and the edge strips 1 and 1*a* have been rotated through 180° in relation to one another with the aid of the hinge connection illustrated in FIG. 2.

FIG. 2 illustrates a "stable" position of adjustment achieved with the aid of configured edges 9, 9*a* and 10, 10*a* . The configured edges 9, 9*a*, 10, 10*a* are defined by curved surfaces. Furthermore, the configured edges 9, 10 define a gap 15, and the configured edges 9*a*, 10*a* define a gap 16. Rotation of the panels "A" and "B" to the position illustrated in FIG. 3 takes place under "instable" positions of adjustment, since rotation or pivotal movement of the panels is effected with the aid of circular-arcuate rolling surfaces.

It will be understood that one of these surfaces, or both said surfaces, can have a curvature which is different to that illustrated.

FIG. 4 illustrates an edge strip of different cross-sectional shape and suitable for use with an inventive hinge connection comprising a first hinge element 3 and a second hinge element 4, in principally the same manner as that described with reference to FIGS. 2 and 3.

FIG. 5 illustrates a third embodiment of the cross-sectional shape of a suitable edge strip with which there is used a first hinge element 3 and a second hinge element 4 of the kind illustrated in FIGS. 2 and 3.

FIG. 6 is a side view of a hinge element 4 which comprises a first hinge member 4*a* and a second hinge member 4*b* and a band 4' which connects said hinge members. The length of the band is adaptable for attachment purposes and to the cross-sectional profile of the edge strip used.

As illustrated in FIG. 6, each hinge member 4*a*, 4*b* has an outwardly directed extension which functions as a lever arm and which tapers outwardly to a wedge shape, with the point 4*a*of the wedge intended to coact with an attachment means, which in the illustrated case has the form of a hooked projection 5 on the edge strip l*a*.

The other pointed end 4*b'* of the hinge member similarly coacts with a hook projection 5*a* on the edge strip 1.

According to the present invention, at least one hinge member 4*a* is arranged for pivotal movement around curved edge surface 6 formed in said part, wherein pivotal movement and sliding movement of the hinge member 4*a* results in requisite stretching of the band 4', through the intermediary of a lever-arm arrangement.

The hinge member 4*a* is configured with a curved abutment surface 7 intended for coaction with the curved edge surface 6, and the edge surface and/or said abutment surface may be provided with sliding-preventing means, such as a roughening or serrations.

As illustrated in FIGS. 2, 4 and 5, the surface of the first structural part or edge strip facing towards the second structural part or edge strip, and the surface of the second structural part facing towards the first structural part are mutually parallel and abut one another when said structural parts, or panels, define an angle of 180° therebetween.

In the case of the FIG. 2 embodiment, this surface is defined by an imaginary plane which contains two mutually parallel edges 9, 10 and 9, 1O*a*. In the embodiment illustrated in FIGS. 4 and 5, the surface 11, 11*a*, 12, 12*a* is comprised of planar surfaces whose widths negligibly smaller than the length of the band.

In order for the inventive hinge connection to function satisfactorily, it is necessary to pre-stretch the band 4' to a predetermined extent, and to this end the band is selected from a material whose modulus of elasticity is suitable for the said purpose.

Furthermore, as will be seen from the drawings and particularly from FIG. 2, two surfaces 9' 10' bordering the surface 9, 10 are curved, preferably in a part-cylindrical configuration.

A first hinge element 3 comprising hinge members 4*a*, 4*b* and an intermediate band 4' is mounted for pivotal coaction with one side part 1' of the first structural part or panel 1 and the other side part 1*a'* of the second structural part or panel 1*a*.

A second hinge element 4 is mounted for pivotal coaction with one side part la' of the second structural part or panel la and the second side of the first structural part or panel 1.

It will be seen that the one hinge member 4*a* is identical to the other hinge member 4*b*. One hinge element 3 is also identical to the other hinge element 4.

The one and/or the other hinge member 4*a*, 4*b* is attached to the frame or edge strip through an extension 4*a'* which passes over an attachment ridge 5.

The choice of an appropriate modulus of elasticity for the hinge element 3 or 4 is not the only significant feature concerning satisfactory function of the invention, but also that the hinge element shall be capable of holding the edge strips 1, 1*a* pressed together with a force which provides a good hinge function and which exceeds the force required solely to hold the panels or edge strips in abutment with one another.

The magnitude of this force can be varied upwards, by increasing the thickness and/or the width of the band 4'.

The magnitude of the force can also be varied upwards, by reducing the length of the band 4' between the hinge members 4*a* and 4*b*, and therewith require the band to be stretched further when fitting the hinge element.

A suitable tension force can be reached with the aid of practical tests. Insufficient tension in the band 4' will result in excessive separation of the edge strips 1, 1*a* when the strips are subjected to a force which strives to part the strips.

Excessive tension results in troublesome stresses and strains, particularly on the band and its point of attachment.

FIG. 8 illustrates a case in which a hinge member 4*a''* is inserted into a groove without the possibility of affording any tension there and the band has a length which causes the hinge member 4b'' to take the position illustrated in full lines when the band is subjected to a small tension force. The band is thus short.

When the hinge member 4*b'* is pressed downwards, so as to offer a sliding movement between the surface 6 and the surface 7, the band 4'' is stretched until the outer point of the hinge member has passed the hook 5*a'*.

It follows from this, that at least one hinge member (4*b'*) must be configured so that when attached to a part or a plate of a lever-arm arrangement the hinge member is able to exert a tension force on the band, whereas the other hinge member serves as a counter-force means.

The hinge member 4*b'* is intended to slide over a curved end surface 6' formed in one edge profile of the panel.

The tension force obtained by the lever-arm arrangement is generated by an elastic length extension and/or a resiliency which is greater than 0.5 mm.

The tension force obtained by the lever-arm arrangement can be adjusted by permitting the change in length of the band to be permanent and then adjacent the area referenced 4''in FIG. 8.

Each hinge element is assigned at least one such lever-arm arrangement and at least two hinge elements should be located close together.

It lies within the scope of the present invention to produce the hinge element and the band from steel or metal sheet.

When a plastics material is used, particularly polypropylene, the stretch induced in a band which has a length of 30–50 mm, a thickness of 0.2–0.5 mm and a width of 15–20 mm , is adapted to 0.2–2.0 mm, preferably 0.5–1.0 mm.

When steel is selected, the profile material may have a greater resiliency and the above values may be reduced somewhat.

The band may advantageously be placed in a separate recess in mutually facing surfaces of the edge strip.

FIG. 8 illustrates the hinge member 4*b'* located adjacent the edge surface of the panel and beneath the curved surface 6'.

The invention is not restricted to the described and illustrated embodiment, and modifications can be made within the scope of the following claims.

We claim:

1. A hinge for pivotally connecting at least two panels, comprising:

a first hinge element and a second hinge element, each of said hinge elements being attachable to one of the two panels;

a flexible band extending between the first and second hinge elements;

means arranged on one end of said band for tensioning said band, said first hinge element having a curved edge surface for engaging the tensioning means;

said tensioning means including means for allowing a user to pivot the tensioning means about the curved edge surface so as to increase the tension in said band; and said tensioning means also includes an abutment surface extending away from one side of the band for engaging said curved surface on said first hinge element, wherein said abutment surface is formed by a surface of a wedge-shaped member on the end of said one side of said band;

means, projecting from the first hinge element, for abutting a tip of the tensioning means and maintaining a level of tension in said band.

2. A hinge as claimed in claim 1, wherein said abutting means abuts a tip of said wedge-shaped member on a side of said wedge-shape member which is opposite said one side of the band.

3. A hinge as claimed in claim 2, wherein said wedge-shaped hinge element is integrally formed with said band.

4. A hinge as claimed in claim 1, wherein said edge surface includes sliding-preventing means.

5. A hinge as claimed in claim 1, wherein said abutment surface includes sliding-preventing means.

6. A hinge as claimed in claim 1, wherein the band spans over a gap in the surface of the first and second hinge elements, said gap in the surface of the first hinge element and said gap in the surface of the surface of the second hinge element being aligned with each other when said panels are in one configuration.

7. A hinge as claimed in claim 6, wherein said one configuration is when the two panels are approximately 180° apart.

8. A hinge as claimed in claim 6, wherein said gaps are defined by curved surfaces on said hinge elements.

9. A hinge as claimed in claim 1, wherein when the flexible band maintains the level of tension in the band, the flexible band stretches by more that 0.5 mm.

10. A hinge as claimed in claim 1, wherein when the flexible band maintains the level of tension in the band, the flexible band stretches permanently.

11. A hinge as claimed in claim 1, wherein at least two flexible bands are mounted in close adjacent relationship.

12. A hinge as claimed in claim 1, wherein the flexible band has a modulus of elasticity which is substantially the same as the modulus of elasticity of polypropylene plastic.

13. A hinge for pivotally connecting at least two panels, comprising:

a first hinge element and a second hinge element, each of said hinge elements being attachable to one of the two panels;

at least one flexible band extending between said first and second hinge elements;

means arranged on each end of the band for tensioning said at least one band;

each of said hinge elements having at least one substantially recessed portion for receiving one of the tensioning means;

each of said hinge elements having at least one curved edge surface for engaging one of said tensioning means;

said tensioning means including means for allowing a user to pivot the tensioning means about a respective one of the curved edge surface so as to increase the tension in said band; and means, projecting from each of said hinge elements into each said recessed portions in a respective hinge element, for abutting a tip of a respective tensioning means and maintaining a level of tension in said band.

14. A hinge as claimed in claim 13, further comprising:

a second flexible band extending between said first and second hinge elements, said second band having said tensioning means on each end thereof.

15. A hinge as claimed in claim 14, wherein the first band spans over a gap in the surface of the first hinge element and the second band spans over a gap in the surface of the second hinge element, said gap in the surface of the first hinge element and said gap in the surface of the surface of the second hinge element being aligned with each other when said two panels are approximately 180° apart.

16. A hinge as claimed in claim 13, wherein one panel is received between the first and second recessed portions in at least one of the hinge elements.

* * * * *